US011560258B2

(12) United States Patent
Saltzberg

(10) Patent No.: US 11,560,258 B2
(45) Date of Patent: Jan. 24, 2023

(54) INTERNAL SECURING SYSTEM FOR A COLLAPSIBLE TUBE

(71) Applicant: Jack Saltzberg, Valley Village, CA (US)

(72) Inventor: Jack Saltzberg, Valley Village, CA (US)

( * ) Notice: Subject to any disclaimer, the term of this patent is extended or adjusted under 35 U.S.C. 154(b) by 0 days.

(21) Appl. No.: 16/935,851

(22) Filed: Jul. 22, 2020

(65) Prior Publication Data

US 2022/0024643 A1 Jan. 27, 2022

(51) Int. Cl.

| | |
|---|---|
| ***B65D 35/14*** | (2006.01) |
| ***B65D 35/44*** | (2006.01) |
| ***B65D 35/26*** | (2006.01) |
| ***B65D 35/24*** | (2006.01) |
| ***A47K 5/18*** | (2006.01) |

(52) U.S. Cl.

CPC ..... *B65D 35/14* (2013.01); *A47K 5/18* (2013.01); *B65D 35/247* (2013.01); *B65D 35/26* (2013.01); *B65D 35/44* (2013.01)

(58) Field of Classification Search

CPC . A47K 5/18; A47K 5/00; A47K 5/122; B65D 35/14; B65D 35/44; B65D 35/26; B65D 35/247; B65D 35/00; B65D 35/10; B65D 35/18

USPC ..... 141/2

See application file for complete search history.

(56) References Cited

U.S. PATENT DOCUMENTS

| | | | | |
|---|---|---|---|---|
| 3,160,323 | A * | 12/1964 | Weisberg | B65D 35/247 138/119 |
| 3,260,412 | A * | 7/1966 | Larkin | B65D 35/247 138/119 |
| 11,237,118 | B2 * | 2/2022 | Weinstein | G01N 21/8851 |
| 2017/0247149 | A1 * | 8/2017 | Colling | B65D 35/22 |

* cited by examiner

*Primary Examiner* — David J Walczak

(74) *Attorney, Agent, or Firm* — Scott R. Hansen; Viking IP Law

(57) ABSTRACT

Squeezable tubes for holding creams and gels such as toothpaste and a method for progressively collapsing and internally securing a tube in a flattened state. As the user squeezes the tube proximal to one end, the tube collapses. An internal mechanism to retain that portion of the tube in a collapsed position engages. The portion of the tube that no longer holds toothpaste remains in a relatively flat configuration of which sections may be cut off and thrown away. In an alternative embodiment, the internal mechanism is recyclable and/or releasable and the tube is refillable. Tubes may alternatively be used with many other types of contents such as hair shampoo and conditioner, paint, sunscreen, oil, frosting, pudding, ointments, powders, and liquids.

18 Claims, 9 Drawing Sheets

INTERNAL SECURING SYSTEM FOR A COLLAPSIBLE TUBE

BACKGROUND OF THE INVENTION

1. Field of the Invention

The present invention relates to an apparatus and method to secure a collapsible tube in the collapsed position and, as one example, to secure a toothpaste tube in a flattened position once the product has been expelled.

2. Background of the Invention

The following background discussion is not an admission that the matters discussed below are citable as prior art or common general knowledge. Rather, the general background information disclosed herein is directed to describing the problem(s) associated with the current state of the art and a need for a better solution.

Billions of toothpaste tubes are discarded annually, of which most are not recyclable. Tooth brushing twice a day using a fluoridated toothpaste is a crucial preventive measure. The World Health Organization has recommended the yearly use of six tubes of toothpaste of 170 g each per individual.

Many tubes are made from sheets of plastic laminate with a thin layer of aluminum in between. A user squeezes the tube to push toothpaste out of an opening and onto a toothbrush. While this expels some toothpaste from the section of the tube that is squeezed, toothpaste often remains in the section that was already squeezed (see FIG. 1). Consequently, the tube does not go entirely flat. Subsequent squeezing of the tube can push toothpaste back into the previously squeezed section(s).

In 2009, Consumer Reports found that sizeable percentages of various cream and lotion products never make it out of their packaging. In one study, for toothpaste, up to 13% of the paste was stuck to the container.

One problem is because of the way the current tubes are made, consumers tend to leave product inside the tube, causing wasted expense for the consumer and more unrecyclable tubes being thrown away, which isn't good for our environment. Many tubes of toothpaste are manufactured from a hard plastic, which makes it difficult to expel all of the gel or paste, and it is especially hard for children, the elderly, and those with arthritis and dexterity issues to squeeze such a tube.

One workaround is to try to flatten the section of squeezed tube and then roll it up. This requires ongoing effort as new portions of the tube are flattened and rolled. However, the rolled-up portion can loosen, and the flattening effect becomes ineffective.

Attempts have been made to internally secure a flattened tube section. Arrangements with male/female interlocking protrusions are illustrated in U.S. Pat. No. 3,160,323, entitled "CONTAINERS WITH INTERNAL, INTERLOCKING PROTRUSIONS" issued on Dec. 8, 1964 to Weisenberg, and Patent Cooperation Treaty Patent Application WO06009493 published Jan. 26, 2006. In both these arrangements, the male and female protrusions must be carefully aligned in order for the mechanism to secure shut. Misalignment will cause the protrusions not to secure. Also, any toothpaste, paint, or creams can clog the female openings, such that the protrusions cannot lock into place to effectively retain the section in a collapsed configuration.

Also, the prior male/female closing designs created additional thickness and weight, which then requires a thicker tube. Subsequently, manufacturing and shipping costs increase, and because of the added thickness, the tube becomes more difficult to squeeze for children, the elderly, and people with arthritis and dexterity issues. Because these designs require perfect alignment in order to close, even the slightest manufacturing error may not only hinder the design from closing as it should but can actually leave additional space, making it extremely difficult to expel all of the gel or paste.

Another approach has been to include a securing mechanism on the outside of the tube. This is illustrated in, for example, US Patent Publication 20100084427A1, entitled "FOLDING TUBE" and U.S. Pat. No. 7,007,823 entitled "TOOTHPASTE DISPENSING SYSTEM." Because they are on the exterior, these securing systems can get dirty, attract lint and debris, and inadvertently attach to the user's clothing. Also, this type of external securing system can reduce the area available for the product's brand name, directions, and ingredients.

Considering another issue, many collapsible tubes are made with a hard shoulder at the base of the nozzle. Because of this, the section of content in and around the area of the hard shoulder cannot be squeezed by simply squeezing the tube walls together. The user must instead take one or both walls sandwiched together, and push up toward the nozzle. This can be difficult for children, the elderly, and people with arthritis and dexterity issues. This is another reason so much content is left inside plastic and other tubes.

What is needed is an internal system and related method that will reliably and easily secure portions of a toothpaste (or other) tube and that is tolerant of misalignment by the user.

INVENTION SUMMARY

An eco-friendly method of progressively collapsing and securing a tube for creams has several steps. Cream is dispensed from an opening at one end of the tube, the tube being recyclable and having an interior, a sealed distal end, and a proximal end with an opening. The tube has hook-to-hook material on opposing sides of the interior of the tube and contains a cream or liquid. The method includes sealing off a portion of the tube from containing cream or liquid by securing a portion of the tube in a collapsed configuration by pushing opposing sides of hook-to-hook material together. Cream is then dispensed a second time. A second portion of the tube is then secured in a collapsed configuration by pushing opposing sides of hook-to-hook material together.

Various optional steps may be included, either alone or in conjunction with other steps. The step of sealing off may include pushing together at least a portion of hook-to-hook material that extends substantially a full length of the tube. The step of sealing off may comprise pushing together at least one of a plurality of spaced horizontal strips of hook-to-hook material.

The step of sealing off may include pushing together at least one of a plurality of diagonal strips of hook-to-hook material. The step of dispensing cream may include dispensing cream from a tube that has a distal end releasably sealed by securing hook-to-hook material together.

The method may further include refilling the tube with cream. In one approach, hook-to-hook material is disengaged to open the tube for refill, then cutting off a sealed end to refill. In one approach, a straw is inserted into the distal end of the tube to refill it. In another approach, there is squeezing from one end of the tube to seal a portion of the tube and cutting off at least some of the sealed portion from the tube.

Considering now an alternative embodiment, a method of collapsing a tube may include the steps of dispensing cream from an opening at one end of the tube, the tube having an interior, a sealed distal end, and a proximal end with an opening, the tube having hook-to-hook material on opposing sides of the interior of the tube and the hook-to-hook material extending substantially the length of the tube, the tube containing a cream or liquid. The method also includes sealing off a portion of the tube from containing cream or liquid by securing a portion of the tube in a collapsed configuration by pushing opposing sides of hook-to-hook material together;

Another alternative embodiment is as follows. An eco-friendly method of collapsing and refilling a tube for creams, comprising has several steps. In one, cream is dispensed from an opening at one end of the tube, the tube being recyclable and having an interior. The tube also has a sealed distal end and a proximal end with an opening, the tube having hook-to-hook material on opposing sides of the interior of the tube and containing a cream or liquid. The method includes sealing off a portion of the tube from containing cream or liquid by securing a portion of the tube in a collapsed configuration by pushing opposing sides of hook-to-hook material together. A sealed distal end may be cut off prior to refill. A refill device is inserted into the distal end of the tube to refill it. The distal end is resealed after refill by pushing hook-to-hook material together that is proximal to the distal end. In one embodiment, the method includes the step of disengaging the hook-to-hook. The refill device may be, for example, a straw. In an alternative embodiment, the distal end of the tube may include a refill port that is opened to refill the tube.

In any of the embodiments herein, the tube may include a soft shoulder adjacent to the nozzle from which is dispensed the paste, cream, gel, ointment, liquid or any of the other many things the embodiments of the invention may hold. The soft shoulder includes hook-to-hook material on the interior surface, such that the user may collapse and secure the soft shoulder. In an alternative embodiment, the shoulder (whether soft or not) may include a line of weakness such as a line of perforations, an indentation, or other line or pattern of weakness that permits the shoulder to collapse with light pressure from the user.

Further, with any of the foregoing embodiments, the hook-to-hook material may be required to have a open/close life of between 25 and 50 open/close cycles, to ensure durability of the tube, especially when it is a refillable tube. The exterior of the tube may include one or more protrusions that the user may grab to assist in pulling apart secured hook-to-hook material for, as an example, opening the interior of the tube for refill.

Again, the optional features of the foregoing paragraphs in this Summary, for example, may be incorporated individually or in combination with selected other optional features. Consequently, a great many combinations of features are included in the present invention.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE INVENTION

Figure 1:
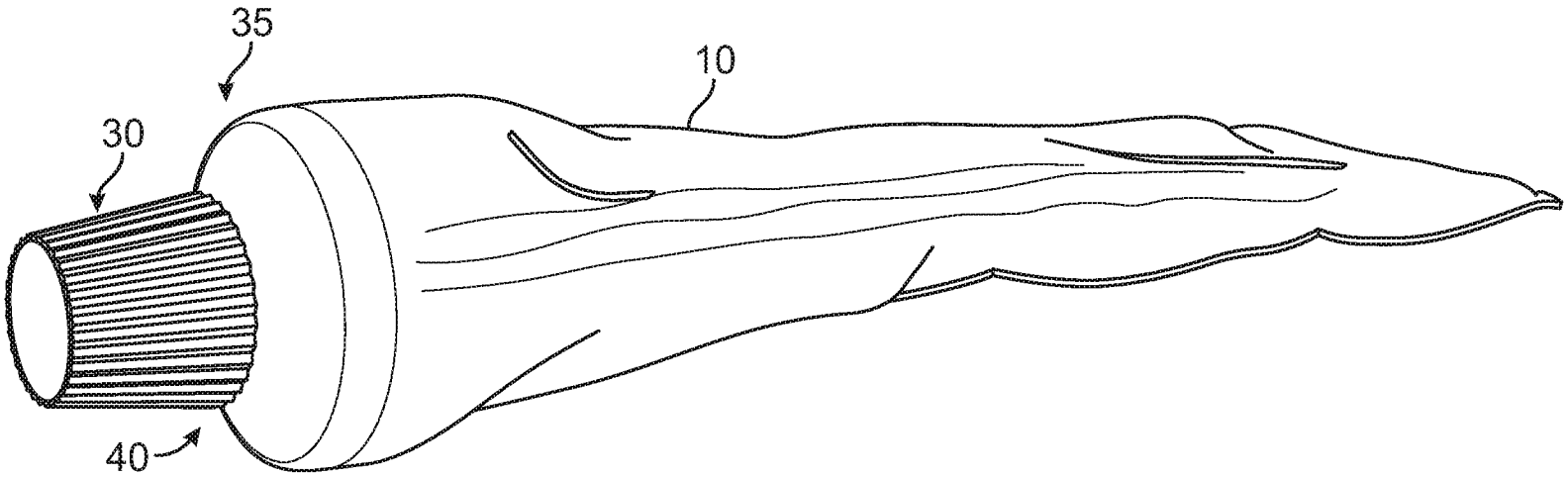
FIG. 1 (PRIOR ART)
FIG. 1 illustrates a prior art tube of toothpaste.

The various aspects of the invention can be better understood with reference to the drawings and descriptions described below. The components in the figures, however, are not necessarily to scale; emphasis is instead placed upon illustrating the principles of the various aspects of the invention. The claimed invention is not limited to apparatuses or methods having all of the features of any one apparatus or method described below or to features common to multiple or all of the apparatuses described below. The claimed invention may reside in a combination or sub-combination of the apparatus elements or method steps described below. It is possible that an apparatus or method described below is not an example of the claimed invention. In general, when the terms "may," "is," and "are" are used as a verb in the description corresponding to a particular subject matter, these terms are generally used in this disclosure as an expression of a possibility of such subject matter rather than as a limiting sense such as when the terms "shall" and "must" are used. For example, when the description states that the subject matter "may be" or "is" circular, this is one of many possibilities, such that the subject matter can also include an oval, square, regular, irregular, and any other shapes known to a person ordinarily skilled in the art rather than being limited to the "circular" shape as described and/or illustrated in the corresponding referenced figure. In addition, when the term "may," "is," and "are" are used to describe a relationship and/or an action, these terms are generally used in this disclosure as an expression of a possibility. For example, when the description states that a subject matter A "may be" or "is" adjacent to a subject matter B, this can be one of many possibilities including the possibility that the subject matter A is not adjacent to the subject matter B as it would be understood by a person ordinarily skilled in the art.

The term "cream" as used herein may include gels, ointments, lotions, and other similar contents typically stored and dispensed from a collapsible tube.

Moreover, it is within the scope of the invention to combine the various embodiments disclosed relating to one or more particular drawings and their corresponding descriptions with one or more of the other drawings and their corresponding descriptions disclosed herein and/or other references incorporated herein by reference where such a combination may be combined and practiced by one ordinarily skilled in the art.

The present invention relates to a self-securing collapsible tube for toothpaste or other pastes, gels, ointments and the like including, in some specialized embodiments, powders. Non-limiting examples for the purpose of illustration might include sunscreen, cream, paste, hair shampoo and conditioner, paint, oil, frosting, pudding, ointments, medicines (such as antibiotic ointment, steroid cream, and the like), as well as liquids. It is noted that some creams and/or gels are expensive, such as specialized medicines and luxury creams as examples, and there is a financial motive to squeeze as much product out of the tube as possible.

In an embodiment of the present invention, as the user squeezes the tube, hook-to-hook material on opposite sides of the interior portion of the tube become attached, thereby zippering together a portion of the tube collapsed. In this regard, it is noted that hook-to-hook material is different than hook-to-loop material. Hook-to-hook material is used in the presently-preferred embodiments. Hook-to-hook material relies on hooks on opposing sides connecting and locking with one another to secure the material together.

As will be discussed later, in one presently-preferred embodiment, the hook-to-hook material is a self-engaging closure system with a light pressure. It securely closes, is often made of polypropylene, low-density polyethylene for food-related and other products to be ingested in the body, or another polymer. It ideally has a cycle life of at least 50 openings and closings, and not less than 25 openings and closings to ensure durability and reliability and to allow for refilling and reusing the tube. In some applications, such as for a single-use tube, a lower cycle life is possible. The hook-to-hook material should have strong adhesion for an extended period corresponding to at least the period of time the user will use the tube. For example, for a tube of toothpaste, the hook-to-hook material will preferably remain securely attached when engaged for at least 2 years. For an expensive luxury or other créme or gel that is used slowly over a long period of time, the strong adhesion period may be as high as 5 years or longer.

Hook-to-hook material may come in strips or in custom-made shapes with, optionally, a self-adhesive backing. In a presently-preferred embodiment of the invention, the hook-to-hook material is formed as an integral part of the tube wall during manufacture, such that adhesive is not required.

FIG. 1 illustrates a partially squeezed tube 10 in the prior art, as it appears when partially filled with a cream, gel or ointment [20] such as toothpaste. In FIG. 1, the user has unevenly squeezed the tube. The tube has a cap 30 and an opening 40 (not seen) through which toothpaste can exit when the cap is removed. Alternatively, opening 40 may act as a refill port in refillable embodiments of the invention when the tube is substantially empty.

Figure 2:
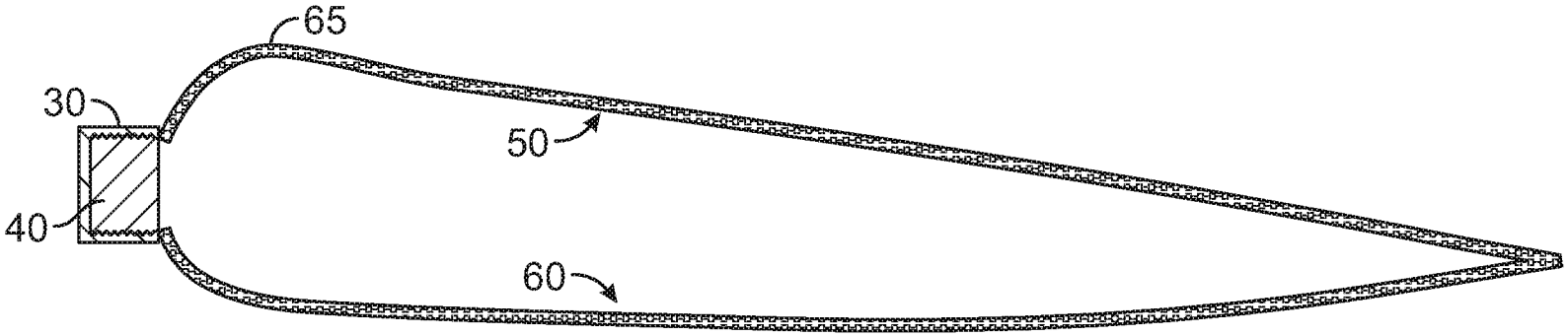
FIG. 2 illustrates a cross-section of a tube according to the present invention, in which hook-to-hook material resides inside the tube.

FIG. 2 is a cross-section of a tube such as in FIG. 1, but incorporating hook-to-hook material on the interior wall. FIG. 2 is a cross-section illustrating a portion of the interior of the tube. Secured to the walls of the tube on opposing sides are complementary hook-to-hook material 50 and 60. The hook-to-hook material may be provided in many forms and configurations. For example, they may be strips extending partially or fully along the length of the tube, including optionally on the interior of the the tube's soft shoulder 65 in embodiments that have a soft collapsible shoulder, as in FIG. 2.

Alternatively, the hook-to-hook material may be provided as spaced strips running the width of the tube. As a further alternative, patches of hook-to-hook material may be provided at desired locations within the tube. In another embodiment, strips of hook-to-hook material may extend diagonally inside the tube.

Typically, the hook-to-hook material may be formed integrally with the tube, such that hook-to-hook material is actually part of the interior wall of the tube. In an alternative embodiment, the hook-to-hook material is secured to the interior wall of the tube through means such as low and/or high heat-sealing, a strong durable adhesive, or other means known in the art. However configured, the hook-to-hook material should remain on the interior wall of the tube for long-term use.

In practice, a user squeezes toothpaste or other cream from the tube. As the user squeezes it, the complementary hook-to-hook material secures together, holding the tube in a collapsed configuration. The distal end of the tube may be sealed in a manner typical for such tubes (e.g. FIGS. 1 and 2), such as by heat sealing for example, or the distal end may simply be sealed using strong hook-to-hook material at the distal end of the tube.

In the embodiment of FIG. 2, the hard shoulder of FIG. 1 35 is replaced by a curving flexible wall of the tube, making it easier to press together at the soft shoulder 65 than at the hard shoulder 35 in FIG. 1. The hook-to-hook material on the inner tube walls at the soft shoulder area 65 can be squeezed together and secured in similar manner as the rest of the tube.

Another alternative embodiment is to create a perforation or line of weakness in the shoulder area on either side of the nozzle (see FIG. 8), for example, thus allowing the typical user to push opposite sides of the soft shoulder area 65 together to squeeze out product from the shoulder area.

Figure 3:
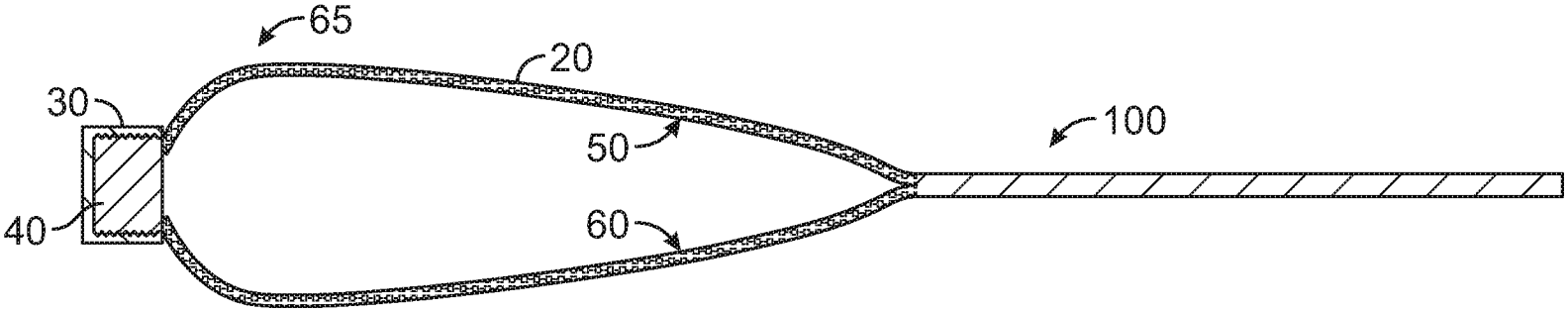
FIG. 3 illustrates the tube of FIG. 2 after a user has squeezed an end of the tube and hook-to-hook material secures the end portion in a collapsed state.
Figure 4:
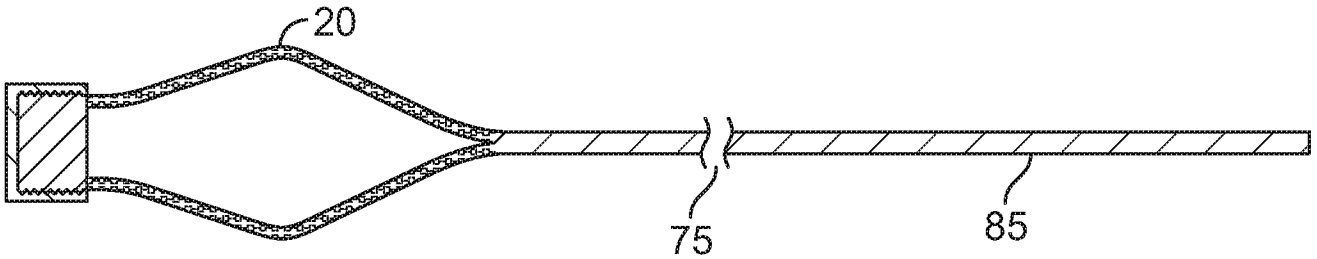
FIG. 4 illustrates the tube of FIG. 2 after more toothpaste has been squeezed from the tube and the user has optionally cut off a collapsed section of the tube.

FIGS. 3 and 4 illustrate a partially collapsed tube 20 which could be the tube of FIG. 2, in which an area from which cream or the like has been squeezed 100 is collapsed and hook-to-hook material is secured together to hold the tube in that area in a collapsed configuration. FIG. 4 is a cross-sectional view illustrating the mating hook-to-hook material portions 50, 60 locked to one another. This keeps the toothpaste or other cream within a smaller area of the tube proximal to the exit 40 of the tube.

Figure 5:
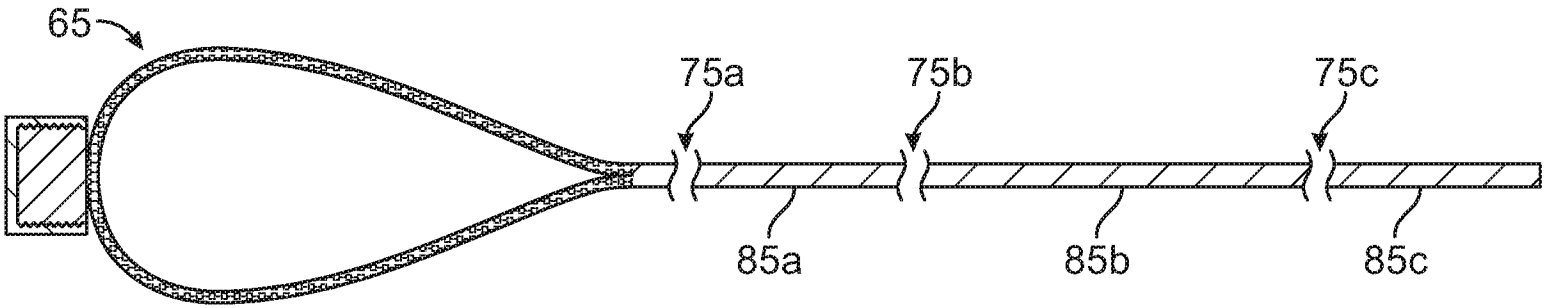
FIG. 5 illustrates the tube of FIG. 2 in which the user has sequentially cut off collapsed sections of the tube as more paste is squeezed out.

As seen in FIGS. 3 and 4, as the tube collapses, a portion of the tube in which there is little or no toothpaste becomes secured and unusable, and the remaining toothpaste is confined to a smaller space proximate to the tube opening. After a sufficient length of the tube 20 has been collapsed and secured, the user may optionally cut off the remaining secured portion 85 of the tube as in FIG. 4, or even sequentially cut-off collapsed/secured portions of the tube 85 a, b, c (FIG. 5). In FIG. 4, reference no. 75 and in FIG. 5, reference nos. 75 a, b, c represent areas omitted from the Figures for compactness.

Figure 6:
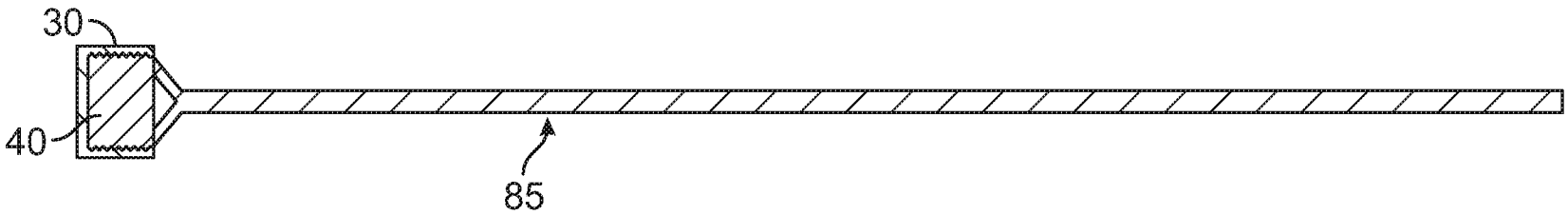
FIG. 6 is a cross-section of an embodiment of a tube with a soft shoulder that is fully collapsed up to the nozzle.
Figure 7:
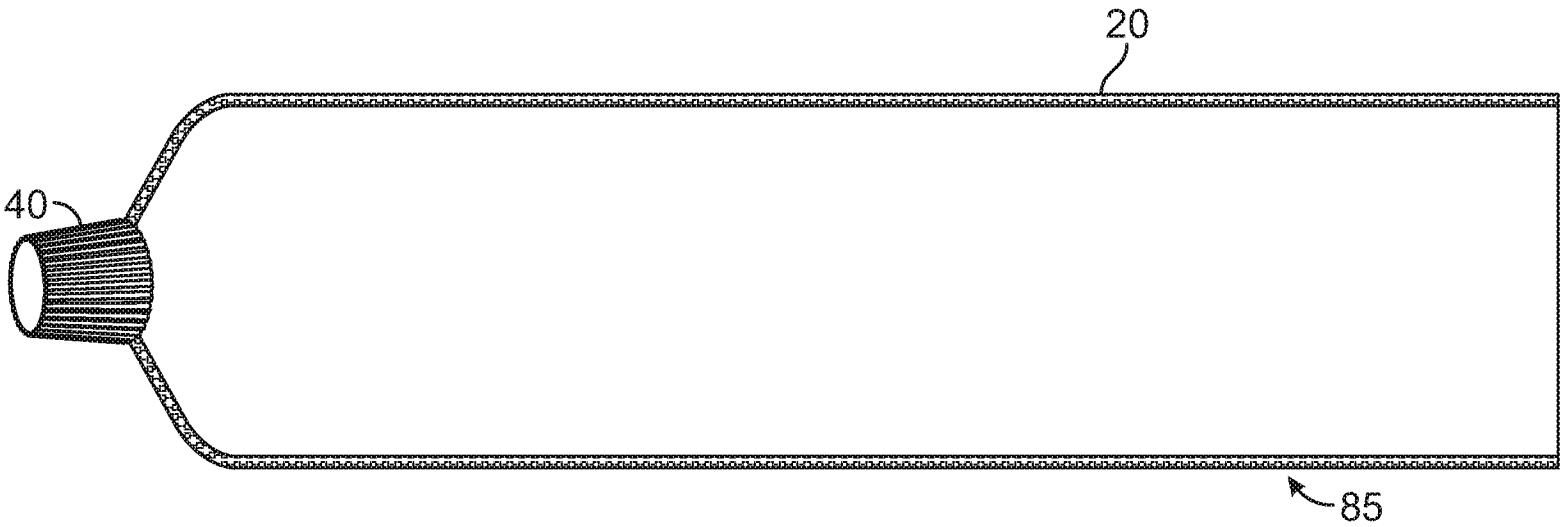
FIG. 7 is an exterior view of the fully collapsed and secured tube of FIG. 5.

Considering now an embodiment with a soft shoulder or a design in which the tube may be fully collapsed, FIG. 6 illustrates an embodiment in which substantially the full length has been collapsed and secured with the hook-to-hook material. The exterior of the collapsed tube of FIG. 5 is illustrated in FIG. 7.

In a further optional embodiment, there may be hook-to-hook material on the walls of the nozzle, so that even the nozzle can be collapsed and secured. This might be of interest, for example, if a hook-to-hook closure of the nozzle is desired instead of a cap for sealing off the nozzle between uses.

Figure 9:
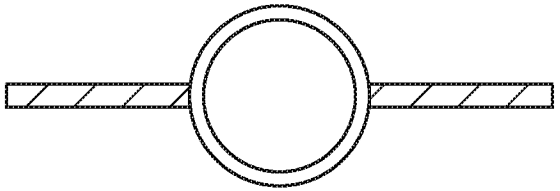
FIG. 9 is cutaway view of a fully-collapsed tube having a collapsible shoulder.
Figure 8:
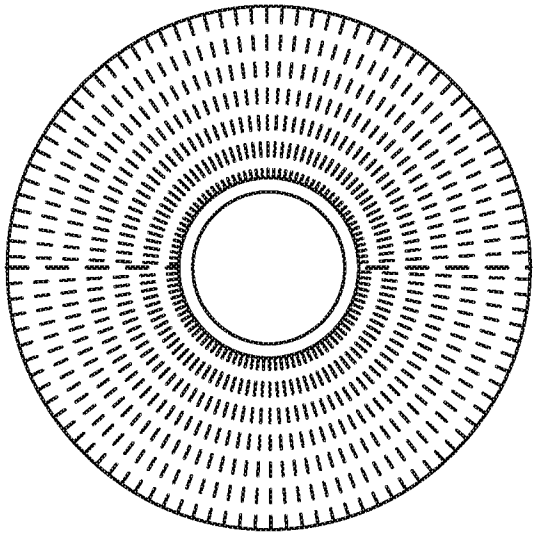
FIG. 8 is a cutaway view of an embodiment in which the shoulder is partially perforated and/or provided with lines of weakness to allow the shoulder to collapse.

FIG. 8 is a view of an embodiment in which hook-to-hook material extends on the interior of the tube up to the nozzle. The shoulders of the tube are flexible and collapsible. In the embodiment of FIG. 8, the shoulder area has been provided with one or more lines of weakness to help the shoulder area collapse. The line of weakness becomes something like a hinge that permits the shoulder area to collapse. FIG. 9 is the embodiment of FIG. 8 shown in partial cross-section such that the hook-to-hook material in the shoulder area is engaged, holding the shoulder in a secured configuration. The outer layer of material at the shoulder is removed in FIG. 9 for clarity so that the hook-to-hook material on the interior of the tube may be seen.

The hook-to-hook material may be, as non-limiting examples, Velcro® PRESS-LOK®, Easylock by Aplix®, and 3M™'s Grip Lock Strips® or Dual Lock™. In one embodiment, hook-to-hook material is made from food-grade, heat-sealable polyethylene material, which can be sealed on a film. Self-mating micro hooks engage on multiple levels making it easy to open and reclose. Precise alignment is not required for sealing. The hook-to-hook material may be recyclable.

US Patents that illustrate different forms of hook-to-hook include U.S. Pat. Nos. 4,984,339, 5,930,876, 5,361,462, and 8,920,902, all of which are incorporated by reference in their entirety.

Considering one specific, non-limiting example, the Velcro® Brand PRESS-LOK® Advanced hook-to-hook closure system can be heat-sealed to the interior wall of the tube. PRESS-LOK® hook-to-hook fastening allows consumers to align the seal well and reliably. An advantage of a suitable hook-to-hook material is that it has been discovered that toothpaste and other creams do not prevent the mating surfaces from locking to one another and securing the tube in a flattened position. Also, the hook-to-hook mating portions do not need to be carefully aligned. If one side shifts slightly relative to the other, they can still easily be pushed together and secured.

The hook-to-hook closures offer ease-of-use for those with dexterity issues. Velcro® Brand PRESS-LOK® Advanced closures, as one example, are recyclable, such that toothpaste and cream tubes may be made of all-recyclable material to help the environment, considering that more than 20 billion toothpaste tubes are currently unrecyclable and discarded every year.

It is noted that hook-to-hook material is different than hook-and-loop style fastener, commonly known as the original Velcro®, which is characterized by a strip of looped fibers that pairs with a strip of micro-hooks, whereas hook-to-hook fasteners are comprised of two sides of the same plastic hooks or shapes. Whereas the "loops" in the hook-and-loop fasteners easily clog up, the hook-to-hook system can zipper close through powder, debris, creams, pastes, and liquids. It is presently common in the bag manufacturing industry to use hook-to-hook systems, not hook-and-loop, for resealable packaging, such as cereals, rice, dry foods, powders, and dry dog foods, or any other products that would normally clog a hook-and-loop system or zip-lock system.

Additionally, the "loop" side of a hook-and-loop closure will begin to show the effects of use over time, whereas plastic hook-to-hook closures do not lose their shape with repeated use and are viable for reusable tubes. Velcro tested their PRESS-LOK® system more than 300 times and it did not lose its ability to open and close.

I have discovered that hook-to-hook material is advantageous to use in conjunction with a tube for creams such as toothpaste. Hook-to-hook material is thinner than typical closures; can be repeatedly closed and opened for reusable tube purposes; has easy, high-quality, open-and-close performance for consumers; does not require precise alignment for effective closure; provides a pleasing tactile feedback when pressed together; and is especially useful for the elderly, children, and those with arthritis and dexterity issues.

Hook-to-hook material can also have a thinness and flexibility that enable rapid and easy application onto films for improved manufacturing productivity. It can integrate onto manufacturing equipment with minimal modifications, reduces cost, and has less film deformation for a presentable shelf product. The performance of hook-to-hook material is not compromised by the presence of paste, creams, oil, etc. It can be sealed onto polyethylene films, Mylar, and aluminum; can be 100% LDPE suitable for food contact; and can work in both hot and cold temperatures Considering now orientation of the hook-to-hook material, the material may extend width-wise across the full width of the tube or may extend just partway across the tube. Similarly, the hook-to-hook material may run substantially the full length of the tube or may extend just a portion of the length such that only part of the tube is collapsible.

Although a toothpaste tube is presently preferred, embodiments of the invention may be used with other creams, pastes, and/or gels, such as hair shampoos and conditioners; oil; sun screen; ointment; medical creams, ointments or gels; basil or garlic paste; frosting; pudding; liquids; paints; glues; and the like.

In an alternative embodiment, the tube is refillable. The hook-to-hook material that secures a collapsed portion of the tube is first released, such that the tube is no longer retained in a collapsed configuration. The tube may be refiled by injecting the content through the nozzle with the pressure "unzipping" or separating the tube walls, or by inserting a straw-like tube into the main tube, which unzips the hook-to-hook system and then content is forced through the straw into the main tube. In one embodiment; the tube may have a refill cap and opening (FIG. 7)—through which a new supply of toothpaste or another cream is injected into the tube to refill the tube. The refill opening may have a removable cap [90], for example, that is removed in order to refill the tube. In another embodiment; the refill opening may be an opening with a one-way valve that allows toothpaste or cream to be input into the tube but that is not permitted to escape the tube at the one-way valve.

Figure 10:
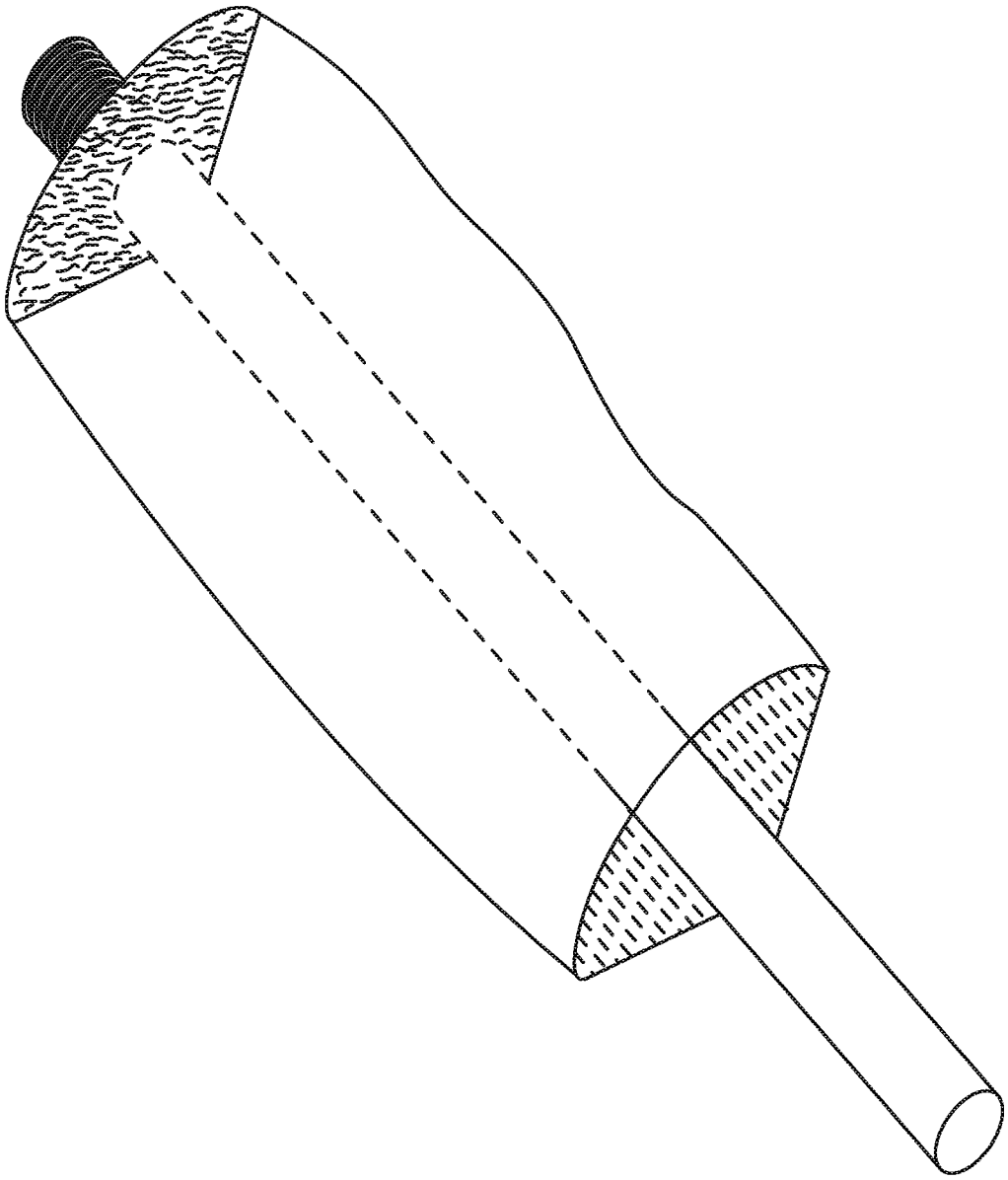
FIG. 10 illustrates a refillable embodiment of the invention.

In another refillable embodiment, illustrated in FIG. 10, the hook-to-hook material itself seals one end of the tube shut, in tear-to-open style. The hook-to-hook material is pulled apart to open the tube at one end to refill the tube. Hook-to-hook material is then pushed together to seal the tube again. In this embodiment, the tube may initially be sealed at the end by traditional means, then cut open for refilling. In yet another embodiment, one end of the tube is secured with a Ziploc-style closure. In this embodiment, hook-to-hook material at the end of the tube may assist in sealing the tube shut.

In another embodiment, once the tube is no longer secured shut, the tube is refilled through the existing tube opening. For example, in a toothpaste tube, the opening through which toothpaste exits when the tube is squeezed becomes a refill port through which to refill the tube. The opening may be sealed by, for example, a threaded removable cap, a snap-shut cover, a slide-shut cover, or other openable sealing mechanism.

The tube may be made of any material from which tubes are made in the prior art, such as a polymer, a thin-walled metal, or other suitable material. In one embodiment, the tube is made of a very flexible material such as Mylar® or thin recyclable polyethylene films, which may assist children, the elderly, and those with dexterity issues while keeping manufacturing cost relatively low. In this embodiment, as in others, there is no need for the mating hook-to-hook material to be perfectly aligned for the hook-to-hook to zipper together and stay secured. All or part of the tube may optionally be made from a recyclable material.

The tube material is not limited to polymers. The tube may be made from composite materials, or even thin-walled deformable metals such as aluminum, as one example.

While various embodiments of the invention have been described, it will be apparent to those of ordinary skill in the art that many more embodiments and implementations are possible within the scope of this invention. For example, hook-and-loop material (e.g. Velcro) may be used in some applications. In refillable applications in which hook-to-hook material must be released from engagement, knobs, ridges, tabs, pull strings and/or protrusions extending from the tube onto which a user may grab to pull apart the hook-to-hook material may be provided.

In other embodiments, the entire tube is made of a pliable polymer, such as for example a thin collapsible plastic, including the nozzle, so that the user can squeeze the additional content residing in the nozzle.

In one variation, the entire tube, including the nozzle, the shoulder, and the hook-to-hook are all made from one piece, a soft thin, pliable plastic that allows easy squeezing, including the nozzle so that the nozzle, too, may be fully flattened. In another embodiment, more than one material is used. For example, the body of the tube may be made of a very flexible material, and the nozzle made of a less flexible material than the body.

In one specialized embodiment, hook-to-hook material is provided in strips that extend across the width of the tube. The strips are spaced. For dispensing medication—such as creams, ointments, and the like—the chosen spacing of the hook-to-hook material may provide a method of dispensing a pre-determined amount of medication. That is, the user squeezes upwardly along the tube until the user feels the next strips of hook-to-hook material engage, then stops squeezing. The amount of cream, ointment, or the like that is expelled from the tube is then a pre-determined amount.

Moreover, various features and functionalities described in this application and Figures may be combined individually and/or a plurality of features and functionalities with others. Accordingly, the invention is not to be restricted except in light of the attached claims and their equivalents.

What is claimed is:

1. An eco-friendly method of progressively collapsing and securing a tube for creams, gels, ointments, and/or other dispensable contents, comprising the steps of:

dispensing cream from an opening at one end of the tube, the tube being recyclable and having an interior, a sealed distal end, and a proximal end with the opening, the tube having hook-to-hook material on opposing sides of the interior of the tube and containing a cream or liquid;

sealing off a portion of the tube from containing cream or liquid by securing a portion of the tube in a collapsed configuration by pushing opposing sides of hook-to-hook material together;

dispensing cream for a second time; and sealing off a second portion of the tube by securing a second portion of the tube in a collapsed configuration by pushing opposing sides of hook-to-hook material together, wherein the step of sealing off a portion comprises collapsing and securing a soft shoulder on the proximal end portion of the tube adjacent to a tube opening.

2. The method as claimed in claim 1, wherein the step of sealing off comprises pushing together at least a portion of the hook-to-hook material that extends at least most of the length of the tube or to the nozzle.

3. The method of claim 1, wherein the step of sealing off a portion comprises collapsing and securing the soft shoulder in a proximal end portion of the tube adjacent the tube opening, in which the shoulder includes at least one line of weakness.

4. The method of claim 1, wherein the step of dispensing cream comprises dispensing cream from the tube that has the distal end releasably sealed by securing hook-to-hook material together.

5. The method of claim 1 further comprising the step of refilling the tube.

6. The method of claim 5 further comprising the step of disengaging hook-to-hook material to open the tube for refill.

7. The method of claim 1 further comprising inserting a straw into the distal end of the tube to refill it.

8. The method of claim 1 further comprising the step of squeezing from one end of the tube to seal a portion of the tube and cutting off at least some of the sealed portion from the tube.

9. The method of claim 1 wherein hook-to-hook material is provided in spaced strips across a width of the tube, the method further comprising squeezing until a first pair of spaced strips engages to dispense a first pre-determined amount of tube contents, then squeezing until a second pair of spaced strips engages to dispense a second pre-determined amount of tube contents.

10. A method of collapsing a tube, comprising the steps of: dispensing cream, gel, ointment, and/or liquid from an opening at one end of the tube, the tube having an interior, a sealed distal end, and a proximal end with an opening, the tube having hook-to-hook material on opposing sides of the interior of the tube, and the hook-to-hook material extending at least most of the length of the tube or to the nozzle, the tube containing a cream or liquid; and sealing off a portion of the tube from containing cream, gel, ointment, and/or liquid by securing a portion of the tube in a collapsed configuration by pushing opposing sides of hook-to-hook material together, wherein the step of sealing off a portion comprises collapsing and securing one of a soft shoulder and a shoulder having a line of weakness.

11. The method of claim 10, wherein the step of dispensing comprises dispensing cream from a tube that has a distal end releasably sealed by securing hook-to-hook material together.

12. The method of claim 10 further comprising the step of refilling the tube with cream.

13. The method of claim 12 further comprising the step of disengaging hook-to-hook material to open the tube for refill.

14. The method of claim 10 further comprising inserting a straw into the distal end of the tube to refill it.

15. The method of claim 10 further comprising the step of squeezing from one end of the tube to seal a portion of the tube and cutting off at least some of the sealed portion from the tube.

16. An eco-friendly method of collapsing and refilling a tube for creams, comprising the steps of:

dispensing cream from an opening at one end of the tube, the tube being recyclable and having an interior, a sealed distal end, and a proximal end with an opening, the tube having hook-to-hook material on opposing sides of the interior of the tube and containing a cream or liquid;

sealing off a portion of the tube from containing cream or liquid by securing a portion of the tube in a collapsed configuration by pushing opposing sides of hook-to-hook material together;

cutting off the sealed distal end prior to refill;

inserting a refill device into the distal end of the tube to refill it; and resealing the distal end after refill by pushing hook-to-hook material together that is proximal to the distal end.

17. The method of claim 16 further comprising the step of disengaging hook-to-hook material to open the tube for refill.

18. The method of claim 16 wherein the refill device is a straw.

* * * * *